US005980138A

United States Patent [19]

Shiozaki et al.

[11] Patent Number: 5,980,138

[45] Date of Patent: Nov. 9, 1999

[54] LABEL PRINTER HAVING MODE SENSOR

[75] Inventors: Tsugio Shiozaki, Susono; Takeshi Tashiro, Yaizu; Yuji Yasui, Shizuoka, all of Japan

[73] Assignee: Toshiba Tec Kabushiki Kaisha, Tokyo, Japan

[21] Appl. No.: 08/750,806

[22] PCT Filed: Apr. 26, 1996

[86] PCT No.: PCT/JP96/01174

§ 371 Date: Dec. 23, 1996

§ 102(e) Date: Dec. 23, 1996

[87] PCT Pub. No.: WO96/33914

PCT Pub. Date: Oct. 31, 1996

[30] Foreign Application Priority Data

Apr. 27, 1995 [JP] Japan ..... 7-103256

[51] Int. Cl.[6] ..... B41J 11/42

[52] U.S. Cl. ..... 400/582; 400/583; 400/594.1; 400/708

[58] Field of Search ..... 400/88, 615.2, 400/586, 582, 583, 594.1, 611, 613, 619, 708

[56] References Cited

U.S. PATENT DOCUMENTS

| | | | |
|---|---|---|---|
| 5,138,336 | 8/1992 | Goto | 400/120 |
| 5,153,606 | 10/1992 | Bas | 346/76 PH |
| 5,229,587 | 7/1993 | Kimura et al. | 400/103 |
| 5,267,800 | 12/1993 | Petteruti et al. | 400/88 |
| 5,336,003 | 8/1994 | Nagashima et al. . | |
| 5,749,662 | 5/1998 | Shibasaki et al. | 400/82 |

FOREIGN PATENT DOCUMENTS

| | | |
|---|---|---|
| 0 191 495 | 8/1986 | European Pat. Off. . |
| 0 250 910 | 1/1988 | European Pat. Off. . |
| 0 605 878 | 7/1994 | European Pat. Off. . |
| 3155954 | 7/1991 | Japan . |
| 3-284965 | 12/1991 | Japan . |

*Primary Examiner*—John Hilten

*Attorney, Agent, or Firm*—Oblon, Spivak, McClelland, Maier & Neustadt, P.C.

[57] ABSTRACT

A base sheet path for peeled issue for guiding a base sheet in a direction different from a label issue port after passing a peeling section following the printing by a printing section and a base sheet path for continuous issue for guiding the base sheet to the label issue port with labels printed by the printing section stuck on the base sheet are provided. Two operating modes, namely, the label peeled issue mode in which the base sheet is set to the base sheet path for peeled issue and the label continuous issue mode in which the base sheet is set to the base sheet path for continuous issue are executed selectively. In this case, depending on the result of detection by a base sheet sensor arranged facing the base sheet path for peeled issue for detecting the presence of the base sheet, namely, depending on the setting state of the base sheet, the label peeled issue mode or the label continuous issue mode is recognized automatically for determining the issue mode. Namely, depending on the difference between the positions at which the base sheet is set in the label peeled issue mode and the label continuous issue mode, the label issue mode is recognized without adding an issue mode parameter to an issue command.

4 Claims, 8 Drawing Sheets

LABEL PRINTER HAVING MODE SENSOR

TECHNICAL FIELD

The present invention relates to a label printer for printing labels continuously stuck on a long base sheet and issuing the printed labels.

BACKGROUND ART

Generally, in many label printers such as mentioned above, labels stuck on a base sheet are printed in a printing section and then the base sheet is carried in the direction in which the base sheet is bent acutely, by which the printed labels are sequentially peeled off the base sheet in a peeling section to be issued from a label issuing port. This mode of issuing labels is generally referred to as "label peeled issue mode." On the other hand, the label printer may also be used in which peeling is not performed every time a printing operation is performed, rather a predetermined number of labels are continuously printed in the printing section to be issued in the state in which the printed labels are issued on the base sheet. This issue mode is generally referred to as "label continuous issue mode." In the label continuous issue mode, the labels are issued as stuck on the base sheet to be labeled later with a labeling device or the like, so that a base sheet carry path subsequent to the printing section differs from that of the label peeled issue mode. Therefore, when setting a base sheet attached with labels, it is necessary to select one of the paths that follow the printing section depending on the mode in which label issue is to be performed.

In operation, these modes differ from each other in control of label stop position for example. In the label peeled issue mode for example, control must be made such that each label stops at a position at which the trailing end of each label remains slightly attached on the base sheet, thereby preventing from peeled completed off the base sheet. On the other hand in the label continuous issued mode, control of label printing position is of main concern, so that control must be made such that the leading edge of each label comes to the printing position when the preceding label has been printed.

Meanwhile, in the label printer of the above-mentioned type, generally, a long base sheet attached with labels is set to the printer body, so that the printer body is formed with an opening surface that is opened/closed with a cover. A platen to carry this base sheet and a pinch roller pressed against this platen are installed on the printer body in a set.

The above-mentioned conventional technology involves the following problems. Conventionally, when a base sheet is set to the label peeled issue mode or the label continuous issue mode, the printer itself cannot recognize in which mode labels are to be issued. Therefore, conventionally, the issue mode is added to parameters contained in a issue command transmitted from a host, and the label printer simply selects the label peeled issue mode or the label continuous issue mode by interpreting this command. As a result, to change the issue modes, the setting state of the base sheet and the system on the host side must be changed, making label printing operation inconvenient.

In addition, to set a base sheet on the conventional label printer, the cover must be opened first, the pinch roller must be detached from the platen manually, and, while maintaining this state, the leading edge of the base sheet fed in the printer body must be inserted in the narrow gap between the platen and the pinch roller. This lowers the operational efficiency of label printing. If the base sheet carrying path is bent, the base sheet inserting work lowers the operational efficiency even further.

It is therefore an object of the present invention to provide a label printer that can recognize the label peeled issue mode and the label continuous issue mode without adding a parameter specifying one of the label issue modes to a label issue command.

It is another object of the present invention to provide a label printer that facilitates selective setting of a base sheet attached with labels between execution of the label peeled issue mode and execution of the label continuous issue mode.

It is still another object of the present invention to provide a label printer that facilitates setting of a base sheet.

DISCLOSURE OF THE INVENTION

In carrying out the invention and according to one aspect thereof, there is provided a label printer that, while sequentially feeding a long base sheet, prints labels continuously stuck on the long base sheet by a printing section and ejects the printed labels from a label issue port, the label printer being selectably provided with a base sheet path for peeled issue for carrying the base sheet in a direction different from the label issue port via a peeling section after the printing in the printing section and a base sheet path for continuous issue for carrying and ejecting the base sheet attached with the labels printed in the printing section from the label issue port, the label printer being further provided with a base sheet sensor that faces the base sheet path for peeled issue to detect for the base sheet, and mode recognizing means for recognizing a label peeled issue mode or a label continuous issue mode according to an output of the base sheet sensor. Consequently, the base sheet path subsequent to the printing section is different between the label peeled issue time and the label continuous issue time: namely, for issuing labels in the peeled state, the base sheet path for peeled issue is set in which the base sheet is carried solely; and for issuing labels continuously, the base sheet path for continuous issue is set in which the base sheet is carried along with labels. Therefore, if the base sheet is detected in the path by the base sheet sensor provided facing the base sheet path for peeled issue, it indicates the setting for the peeled issue; if the base sheet is not detected in the path, it indicates the setting for the continuous issue. Thus, based on the detection result of the base sheet, whether the label printer is to be operated in the label peeled issue mode or the label continuous issue mode can be automatically recognized by the mode recognizing means, thereby making it unnecessary to add an issue mode parameter to the issue command coming from the host. In addition, selection between the issue modes can be performed simply by changing the base sheet setting paths.

In carrying out the invention and according to another aspect thereof, there is provided a label printer that, while sequentially feeding a long base sheet, prints labels continuously stuck on the long base sheet by a printing section and ejects the printed labels from a label issue port, comprising a printer body provided with an accommodating section for accommodating a roll of the long base sheet and an opening provided on one side of the accommodating section; a cover pivotally fixed to the printer body to open or close the opening; a platen facing the opening, rotatably held on the printer body; a print head held on the cover and opposing the platen when the cover is closed; and a pinch roller elastically held on the cover to be pressed against the platen when the cover is closed. Consequently, when the cover is opened, the leading edge of a long base sheet accommodated in the printer body is drawn to a position at which the surface of the platen is covered with the base sheet, and then the cover is closed, the base sheet can be easily set between the platen and the print head and between the platen and pinch roller.

BEST MODE FOR CARRYING OUT THE INVENTION

This invention will be described in further detail by way of example with reference to the accompanying drawings.

Figure 1:
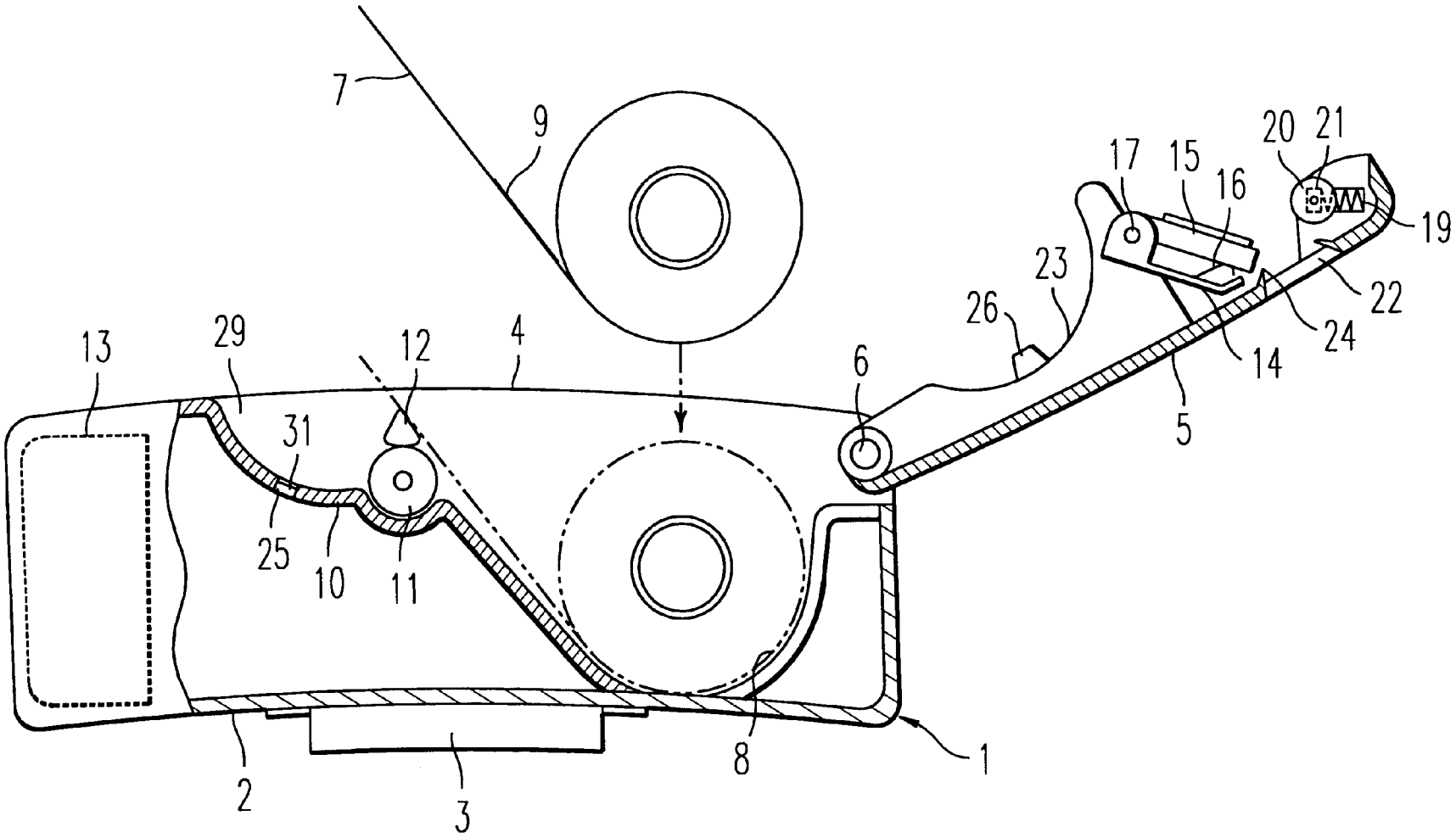
FIG. 1 is a partially cutaway view illustrating a label printer practiced as one preferred embodiment of the invention operated for base sheet setting in the label peeled issue mode.
Figure 7:
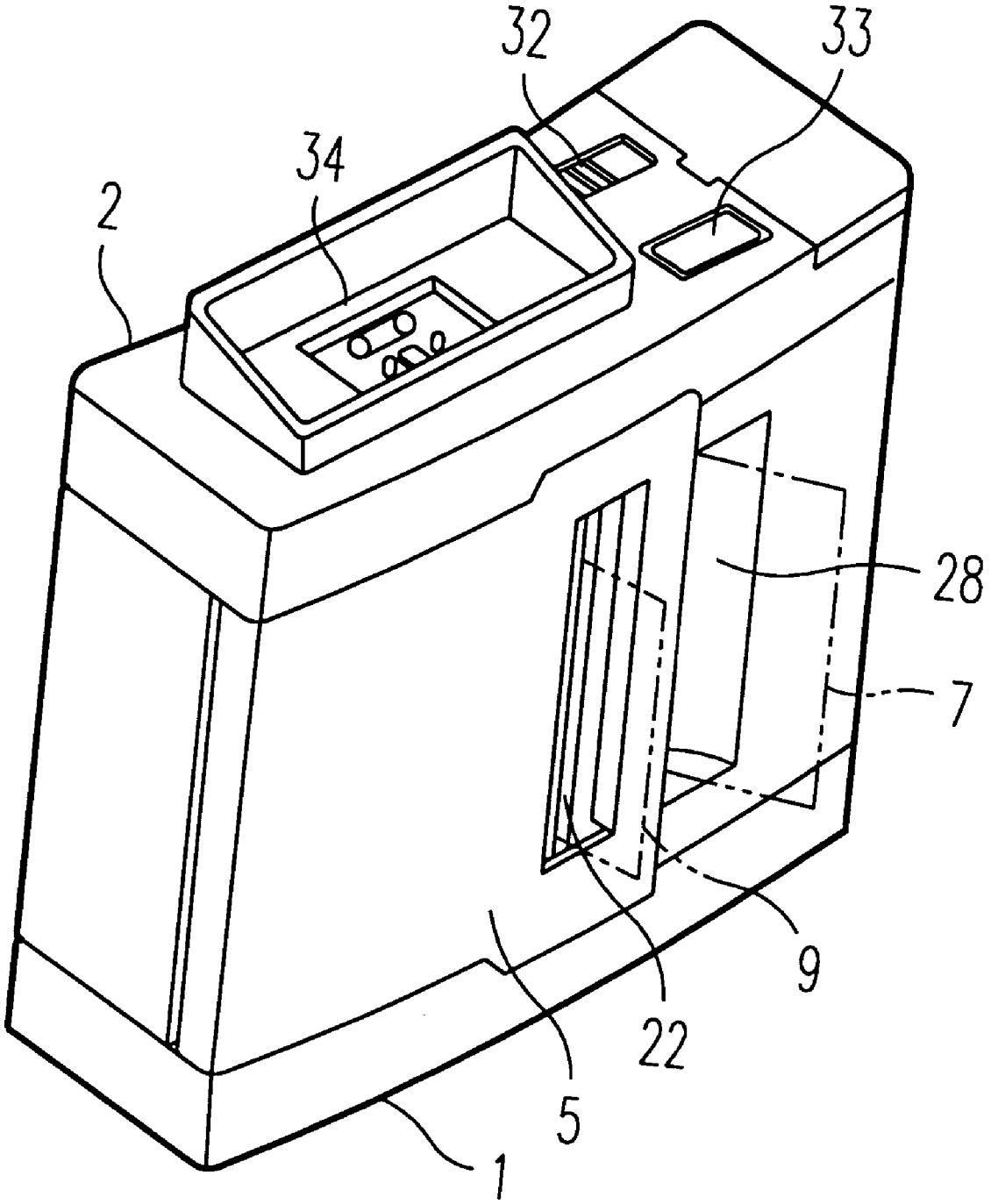
FIG. 7 is a perspective view illustrating the external constitution.

The label printer practiced as one preferred embodiment of the present invention is applied to a portable label printer suitably for use by personnel of delivery services for example. A printer body 1 is formed with an arc surface 2 that allows the label printer to be snugly attached around the waist of the bearer of the label printer, as shown in FIGS. 1 and 7 for example. On the arc surface 2 is formed a belt holder 3 through which a belt or the like of the bearer is passed for holding the label printer.

The printer body 1 is formed at the front side thereof with an opening 4. A front cover 5 is pivotally held on one end of the opening 4 by a pivot 6 to open or close the opening 4. The printer body 1 is formed with a hopper 8 that serves as an accommodating section for accommodating a roll of base sheet 7 in a rolling manner. The base sheet 7 is stuck on one side (on the inner peripheral surface of the roll) thereof with labels 9 continuously.

Further, the printer body 1 is formed with a paper guide 10 that extends from the bottom of the hopper 8 toward the opening 4. The paper guide 10 is arranged at a position near the opening 4 with a platen roller 11 functioning as a rotatable platen and a label peeling block 12 that forms a peeling section along the length of the platen roller 11. In addition, the printer body 1 contains a battery 13.

A thermal head 15 functioning as a print head is pivotally held by a pivot 17 on a head holder 14 fixed inside the cover 5, the terminal head being pressed by a leaf spring 16 in one direction. This thermal head 15 forms a printing section 18 along with the platen roller 11. The cover 5 is provided displaceably at both sides of the free end thereof with a bearing 21 for rotatably mounting a pinch roller 20, the bearing being pressed by a leaf spring 19 in one direction. The front cover 5 is further formed between the thermal head 15 and the pinch roller 20 with a label issue port 22 for ejecting the label 9 and a paper clamp 23 for holding down the base sheet 7 rolled in the hopper 8. A part of an opening edge forming the label issue port 22 of the cover 5 forms a base sheet cutter 24 for cutting the base sheet in the label continuous issue mode to be described, the base sheet cutter being formed in a sharp angle and extended near the tip of the thermal head 15. A transmission-type sensor 25 (refer to FIG. 9) is also provided as a label sensor for detecting the position (state) of the label 9 on the base sheet 7. Moreover, a projection 26 is formed integrally with the cover 5. Inside the printer body 1, a cover open/close switch 27 is provided that is adapted to be closed by the projection 26 when the cover 5 is closed.

The cover 5 is shorter than the opening 4 of the printer body 1; consequently, when the front cover 5 is closed, a base sheet eject port 28 is formed for ejecting the base sheet 7 between the free end of the front cover 5 and the edge of the opening 4. The center of the label peeling block 12 is set to generally match the center of the label issue port 22. The distance from the center of the label peeling block 12 to the center of the pivot 6 is slightly longer than the distance from the tip of the label issue port 22 of the thermal head 15 to the center of the pivot 6 and slightly shorter than the distance from the contact portion between the platen roller 11 and the pinch roller 20 to the center of the pivot 6.

The above-mentioned constitution provides alternatively a base sheet path for peeled issue 29 and a base sheet path for continuous issue 30 as the path for the base sheet 7 subsequent to the printing section 18. The base sheet path for peeled issue 29 is a base sheet carrying path formed by the printing section 18, the label peeling block 12, the portion between the platen roller 11 and the pinch roller 20, the bent portion of the paper guide 10, and the base sheet eject port 28. Facing the base sheet path for peeled issue 29, the paper guide 10 is formed at a part thereof with a reflection-type sensor 31 providing a base sheet sensor for detecting the presence of the base sheet 7. On the other hand, the base sheet path for continuous issue 30 is a base sheet carrying path for carrying and ejecting the base sheet 7 from the printing section 18 directly to the label issue port 22.

It should be noted that although not shown, the front cover 5 is provided with locks that project from both sides of the front cover to be locked on both sides of the opening 4 and operator knobs for unlocking these locks inside.

As shown in FIG. 7, the printer body 1 is provided on top thereof with a power switch 32, a feed key 33 for carrying the base sheet 7 regardless of printing, an optical I/F photo detector 34 for receiving data coming from a handy terminal (not shown).

Figure 9:
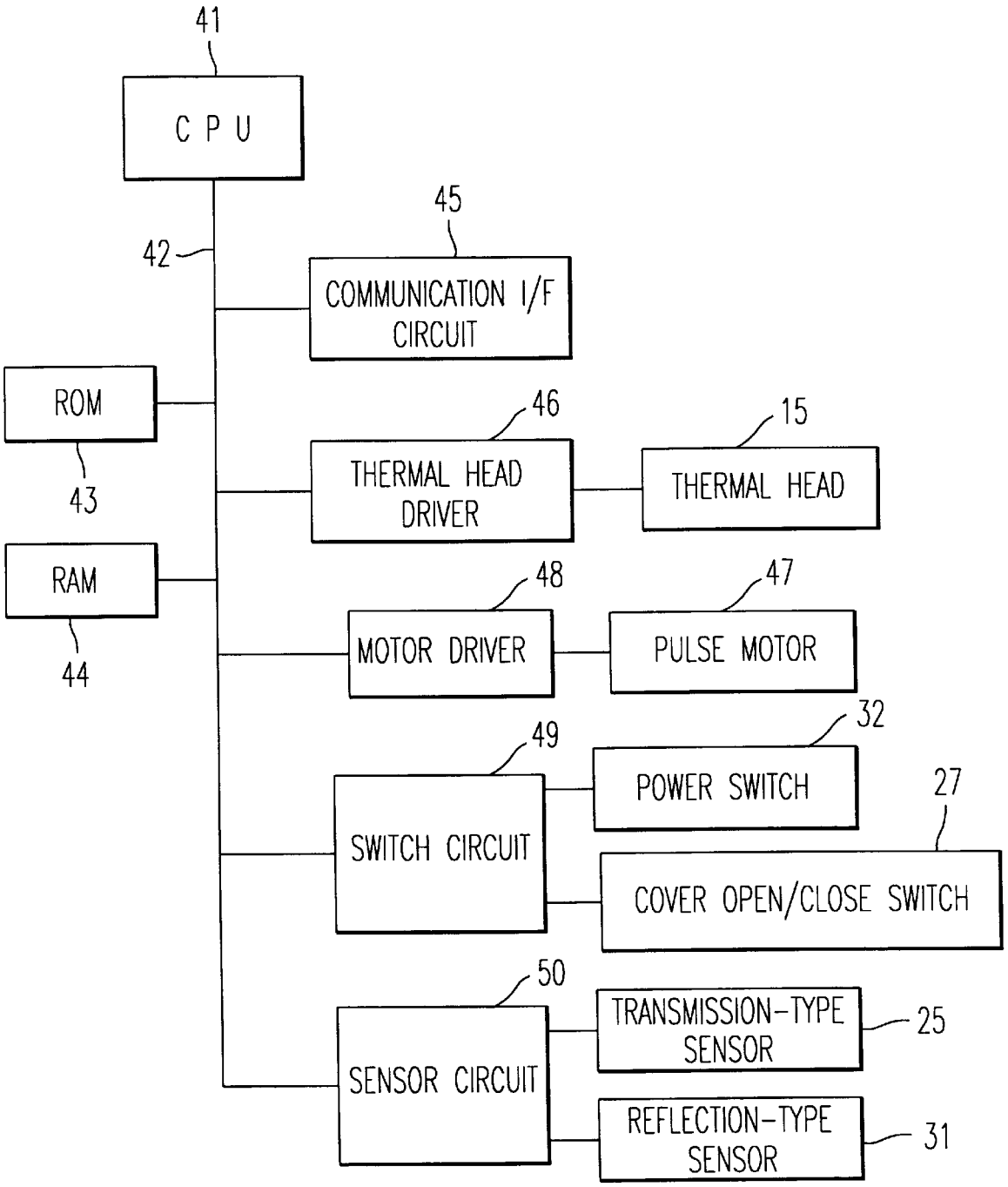
FIG. 9 is a block diagram illustrating the constitution of the electrical control system.

An electrical control system is constituted as shown in FIG. 9. First, a CPU 41 for controlling operations of sections constituting the label printer is provided. The CPU 41 is connected with a ROM 43 for storing fixed data and a RAM 44 for storing variable data via a bus line 42. In addition, the CPU 41 is connected via the bus line 42 with a communication I/F circuit 45 for the optical I/F photo detector 34, a thermal head driver 46 for the thermal head 15, a motor driver 48 for a pulse motor 47 for rotatably driving the platen roller 11 and the like, a switch circuit 49 for capturing switch information on the cover open/close switch 27 and the power switch 32, and a sensor circuit 50 for capturing sensor information on the transmission-type sensor 25 and the reflection-type sensor 31. The capability of mode recognition means to be described later is executed under the control of the CPU 41 based on a program stored in the ROM 43. Further, the RAM 44 is also provided with a storage area for a cover status flag to be described later.

Figure 2:
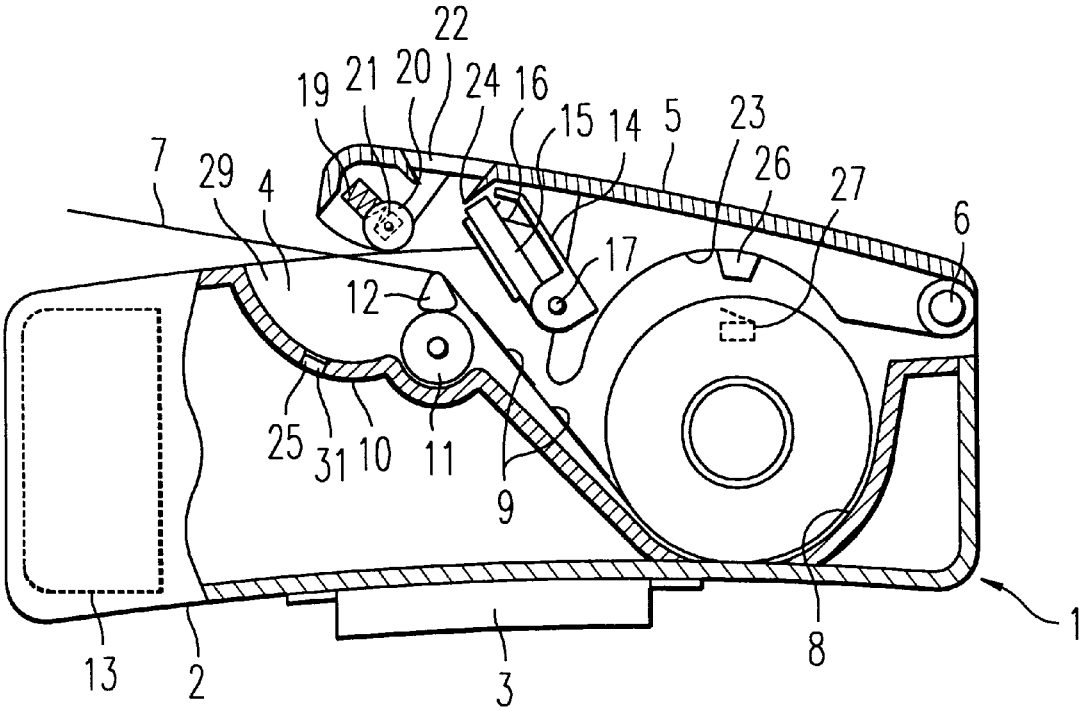
FIG. 2 is a partially cutaway view illustrating the process of closing the front cover in the label peeled issue mode.
Figure 3:
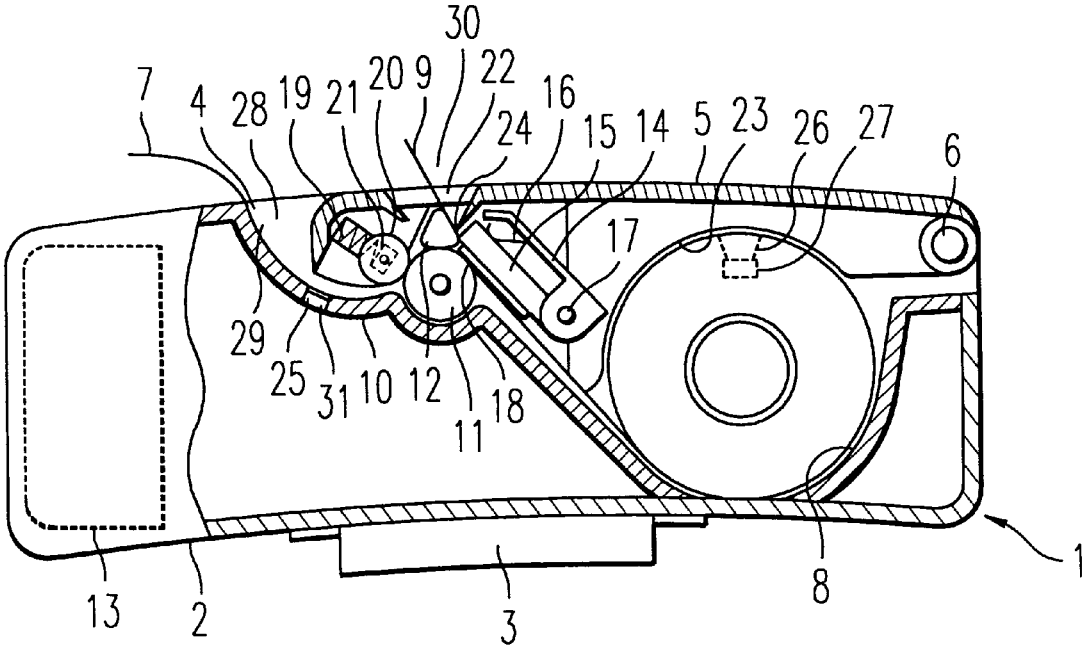
FIG. 3 is a partially cutaway view illustrating the usage state in the label peeled issue mode.

In what follows, use of the label printer having the above-mentioned constitution in the label peeled issue mode will be described. First, the operator knob is operated to unlock the front cover 5 from the printer body 1 to open the front cover 5 as shown in FIG. 1, a roll of base sheet 7 is accommodated in the hopper 8 of the printer body 1, then, in a wide space with the front cover 5 open, the leading edge of the base sheet 7 is drawn to a position at which the platen roller 11 and the label peeling block 12 are covered by the base sheet, and the front cover 5 is closed as shown in FIG. 3 after passing the process as shown in FIG. 2. Thus, the leading edge of the base sheet 7 is bent in an acute angle by the label peeling block 12 and passes between the pinch roller 20 and the platen roller 11 to be drawn out of the base sheet eject port 28, thereby being set in the base sheet path for peeled issue 29 (at this moment, in the leading edge side from the printing section 18, label 9 doesn't exist and therefore the base sheet alone is set). This operation is performed with the printer body 1 held on the waist of the user, and, because such operation is not required as passing the base sheet 7 through a narrow gap between the platen roller 11 and the thermal head 15 and another narrow gap between the platen roller 11 and the pinch roller 20, the setting of the base sheet 7 may be performed extremely easily.

Figure 8:
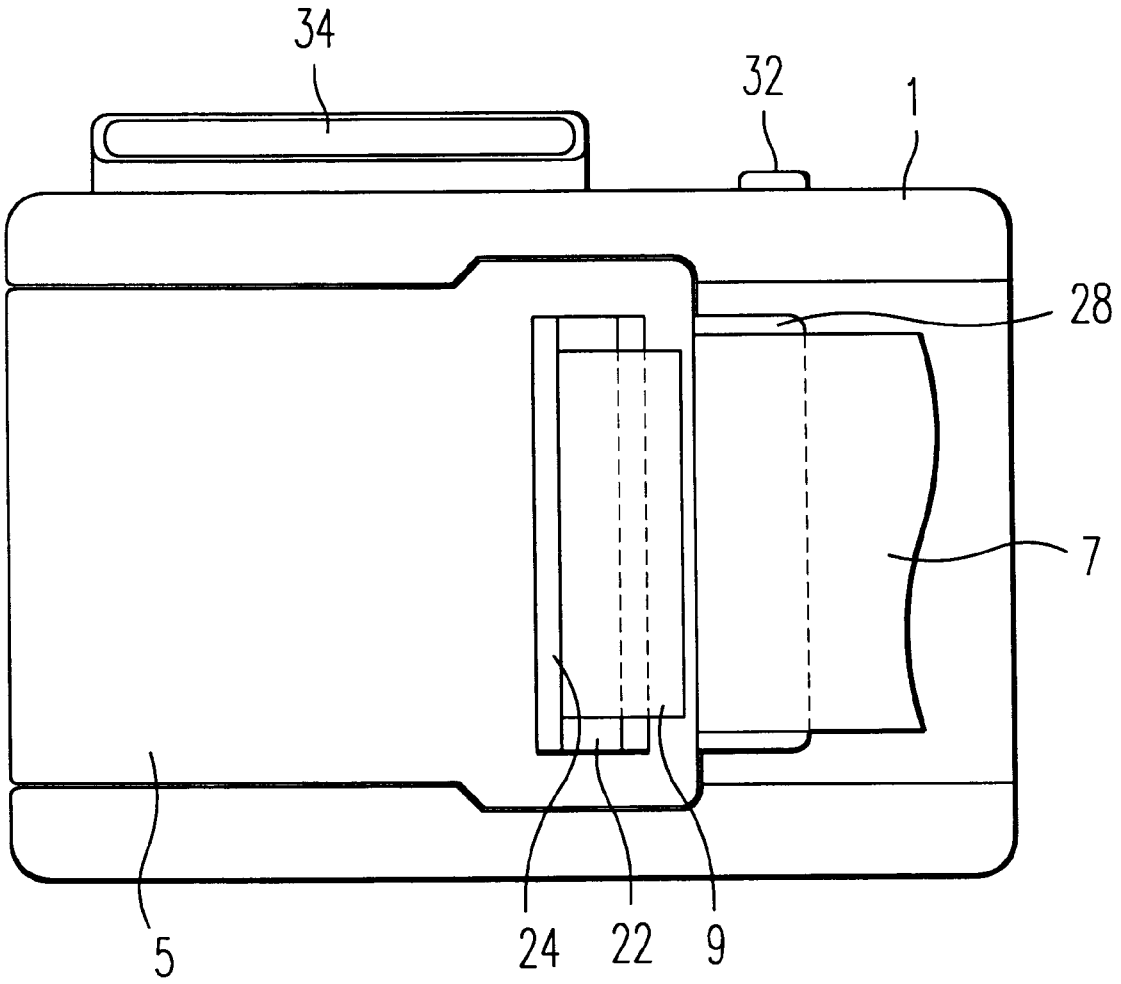
FIG. 8 is an elevated view illustrating the usage state in the label peeled issue mode.

In what follows, the operation to be performed when the power switch 32 is turned on with the base sheet 7 thus set will be described with reference to the flowchart of FIG. 10. Receiving an issue command from the handy terminal via the communication I/F circuit 45 (step S1), the CPU 41 puts the output of the reflection-type sensor 31 in an A/D converter (not shown) in the sensor circuit 50 for A/D conversion (S2). Then, based on the A/D-converted output value of the reflection-type sensor 31, determination is made whether or not there is the base sheet 7 (S3). The determination processing in step S3 is performed by the mode recognition means. In this case, the base sheet 7 is set such that the same runs along the base sheet path for peeled issue 29 and the base sheet 7 is detected by the reflection-type sensor 31, so that the mode recognition means recognizes the label peeled issue mode and performs operations for printing the label 9 while making control such that the control state according to the label peeled issue mode is provided (S4). Namely, the thermal head 15 is supplied with power from the battery 13 to perform print output. Every time one line is printed, the platen roller 11 is driven by one pitch by the pulse motor 47 powered by the battery 13 to carry the base sheet 7 along with the label 9. In this case, the base sheet is carried along the base sheet path for peeled issue 29 in the state in which the base sheet 7 is bent to an acute angle by the label peeling block 12, so that the label 9, which is stiffer than the base sheet 7, runs straight on the label peeling block 12 to be peeled off the base sheet 7, being ejected out of the label issue port (refer to FIGS. 3 and 8). In this case, to prevent the peeled label 9 from dropping inadvertently, the carrying (namely, the stop position of the label 9) of the base sheet 7 is controlled such that the trailing edge of the peeled label 9 slightly remains on the base sheet 7.

Figure 4:
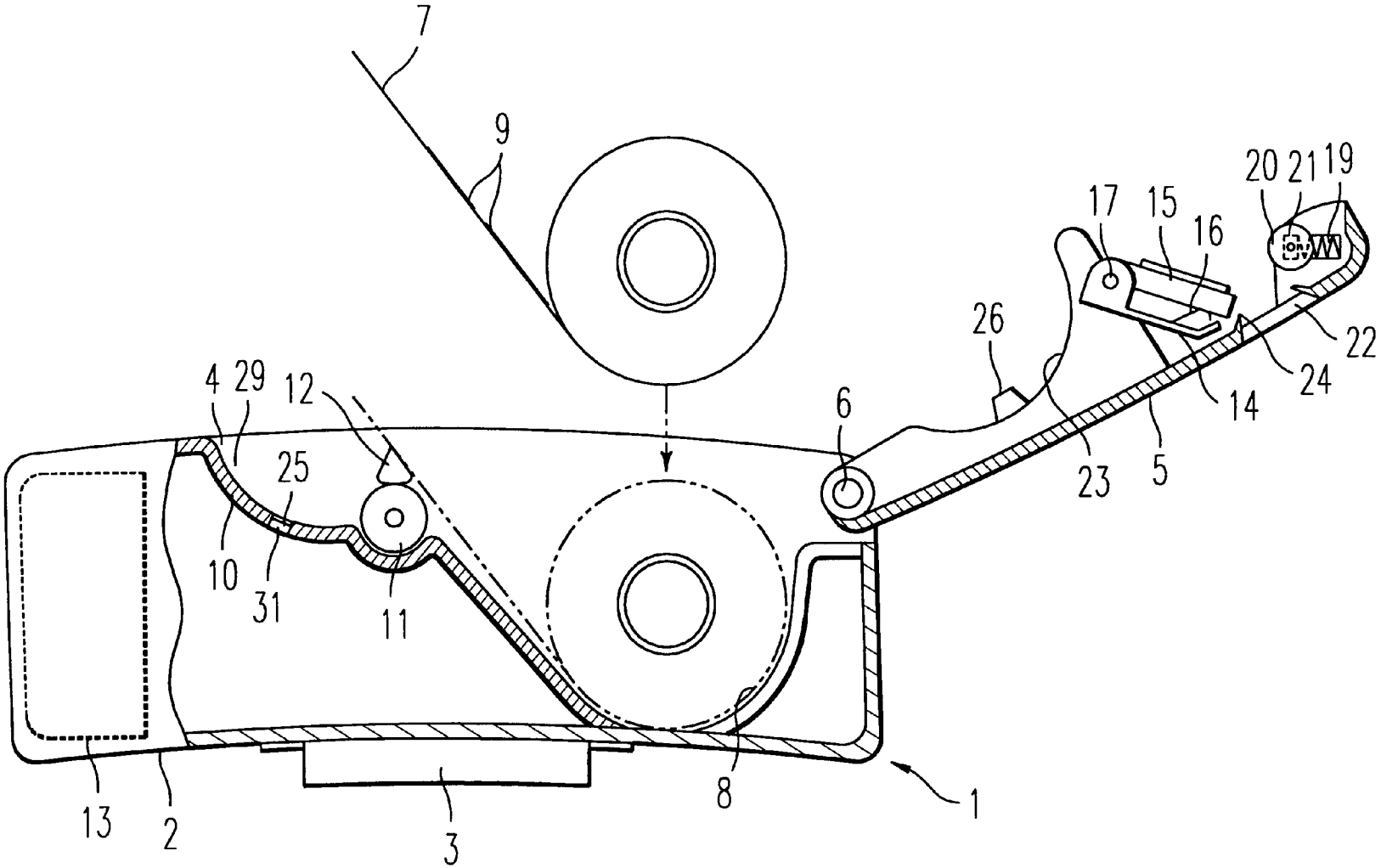
FIG. 4 is a partially cutaway view illustrating the base sheet setting operation in the label continuous issue mode.
Figure 5:
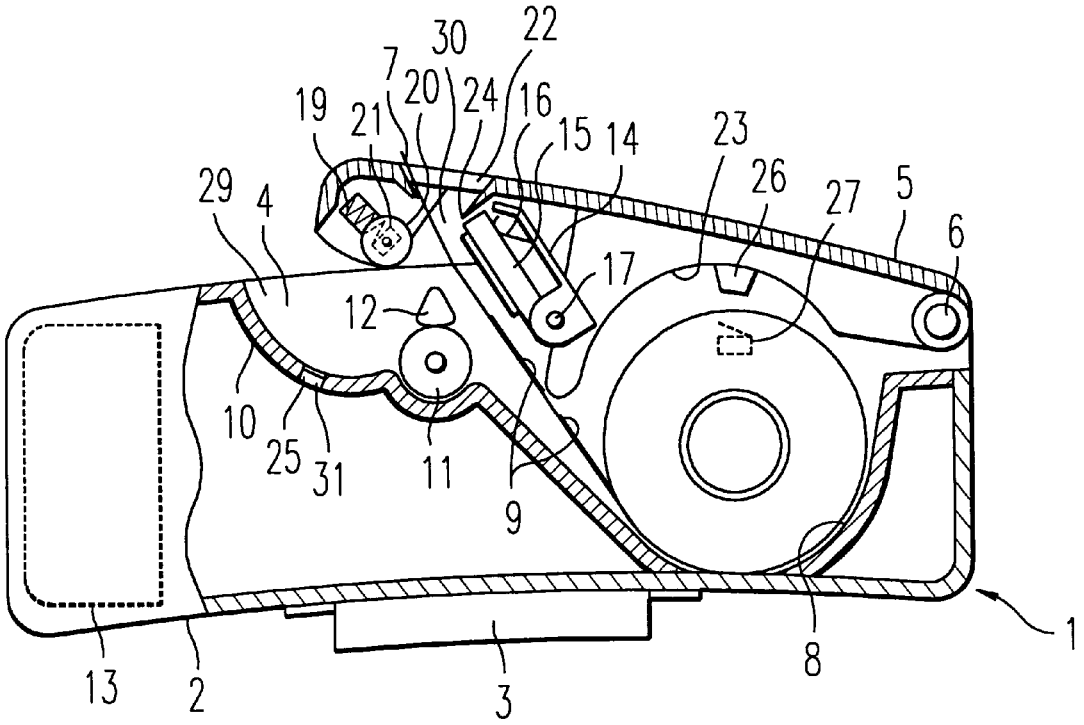
FIG. 5 is a partially cutaway view illustrating the process of closing the front cover in the label continuous issue mode.
Figure 6:
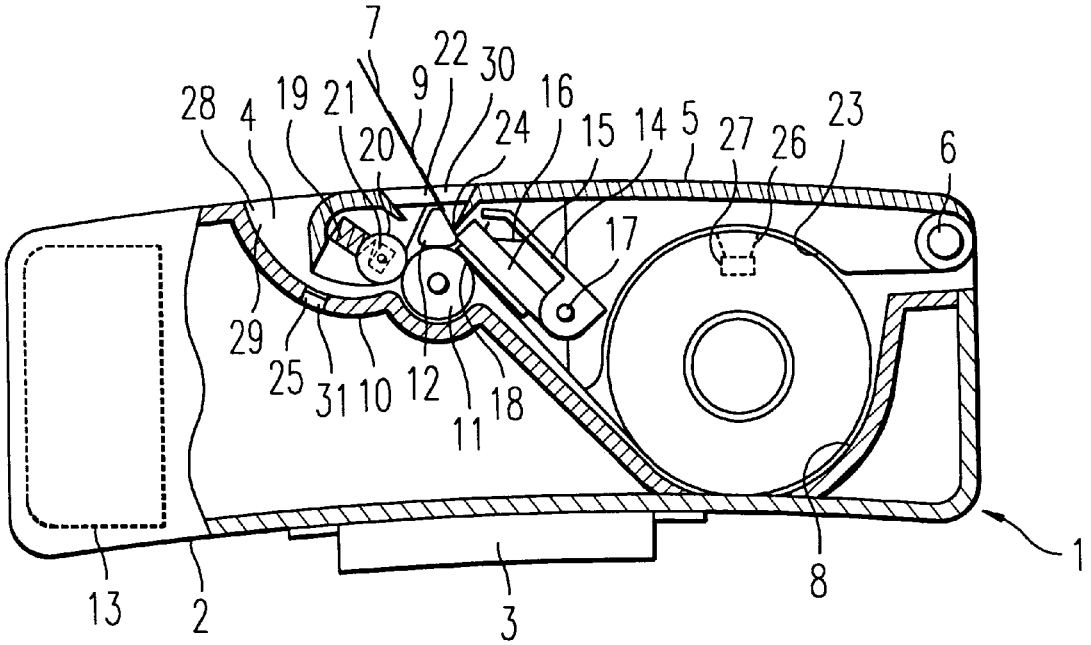
FIG. 6 is a partially cutaway view illustrating the usage state in the label continuous issue mode.

Next, the operation to be performed in the label continuous issue mode will be described. In this case, the front cover 5 is opened as shown in FIG. 4 (the procedure is the same as described before), a roll of the base sheet 7 is accommodated in the hopper 8, and, in the wide space provided by the opened front cover 5, the leading edge of the base sheet 7 is drawn to a position at which the leading edge slightly projects, and the front cover 5 is closed as shown in FIG. 6 after passing the process in which the leading edge of the base sheet 7 is passed through the label issue port 22. Thus, the base sheet 7 is set to the base sheet path for continuous issue 30 such that the base sheet 7 is drawn out directly from the printing section 18 to the label issue port 22 along with the label 9 without being bent by the label peeling block 12.

Figure 10:
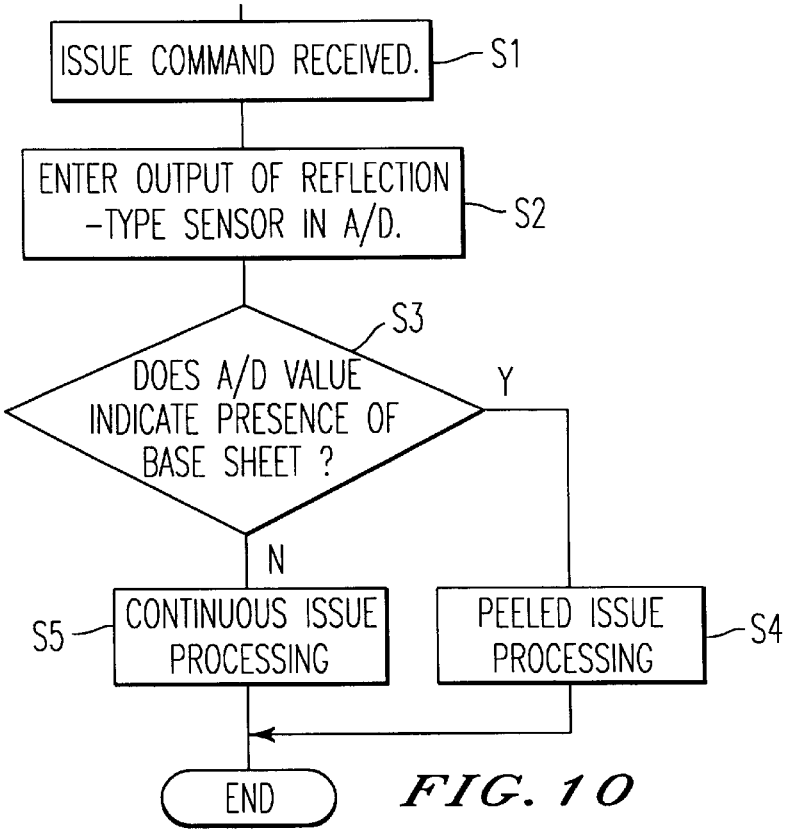
FIG. 10 is a flowchart describing the issue mode recognition processing.

The operation to be performed when the power switch 32 is turned on with the base sheet 7 set in this state, with reference to the flowchart of FIG. 10. Receiving an issue command from the handy terminal via the communication I/F circuit 45 (step S1), the CPU 41 puts the output of the reflection-type sensor 31 in the A/D converter (not shown) in the sensor circuit 50 for A/D conversion (S2). Then, based on the A/D-converted output value of the reflection-type sensor 31, determination is made whether there is the base sheet 7 (S3). The determination processing in step S3 is performed by the mode recognition means. In this case, the base sheet 7 is set such that the same runs along the base sheet path for continuous issue 30 and the base sheet 7 does not exist in the base sheet path for peeled issue 29, so that the reflection-type sensor 31 does not detect the base sheet 7. Therefore, the mode recognition means recognizes the label continuous issue mode and performs operations for printing the label 9 while making control such that the control state according to the label peeled issue mode is provided (S5). Namely, the thermal head 15 is supplied with power from the battery 13 to perform print output. Every time one line is printed, the platen roller 11 is driven by one pitch by the pulse motor 47 powered by the battery 13 to carry the base sheet 7 along with the label 9. This operation is continuously performed for the number of labels to be issued. Namely, the feed of the base sheet 7 (the label 9) is controlled such that, when the preceding label 9 has been printed, the leading edge of the following label 9 comes to the position at which printing by the printing section 18 is performed. The printed label 9 goes through the label issue port 22 along with the base sheet 7. When the printing and issue of the specified number of labels have come to an end, stop control is performed on the base sheet 7 based on the output of the transmission-type sensor 25 such that the portion between the last label and a following label comes to the base sheet cutter 24. When the user cuts the base sheet 7 with the base sheet cutter 24 by holding the leading edge of the base sheet 7, the base sheet 7 with the specified number of printed labels 9 stuck thereon is issued out of the label issue port 22.

Thus, according to the present embodiment, depending on whether the base sheet 7 is set to the base sheet path for peeled issue 29 or the base sheet path for continuous issue 30, the issue mode to be used is automatically recognized by the mode recognition means based on the output of the reflection-type sensor 31, thereby making it unnecessary to add a parameter indicating the issue mode to an issue command on the host side. In addition, the selection of the issue modes can be performed simply by changing the setting states of the base sheet 7.

Figure 11:
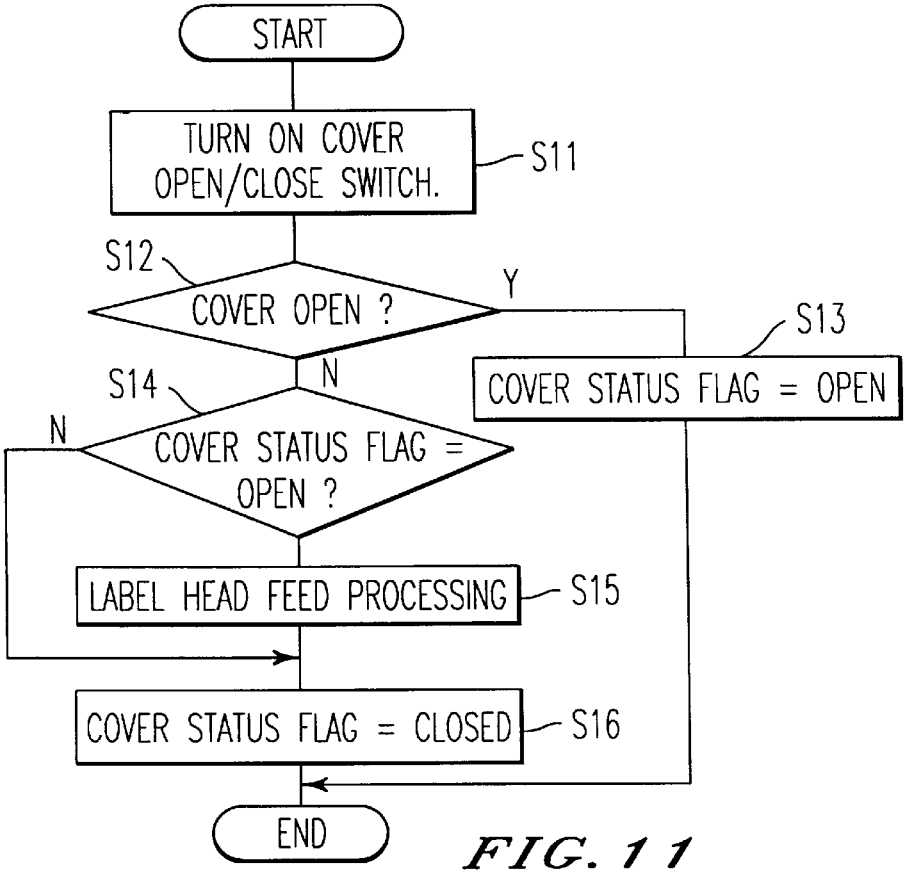
FIG. 11 is a flowchart describing the label leading-edge setting processing.

Meanwhile, in the present embodiment, when a new roll of label 9 (base sheet 7) is set after using up the existing label 9 (base sheet 7) in the printer body 1, the pulling of the leading edge of the label 9 into the printing section 18 is automatically performed according to the control described in the flowchart of FIG. 11. First, the CPU 41 periodically monitors the state of the cover open/close switch 27 (S11) and, according to the state of the cover open/close switch 27 at that moment (S12), sets the cover status flag to the open state if the front cover 5 is open (S13) or the closed state if the front cover 5 is closed (S16). When the new label 9 (base sheet 7) is set and the front cover 5 is closed after performing the processing of step S13 with the front cover 5 opened for label replacement, it is determined, after steps S11 and S12, that the label replacement has been performed (Y of S14) because the cover status flag is set to the open state, starting the feed processing for setting the leading edge of the new label 9 in place (S15). Thus, the leading edge of the first label 9 is set to the position of the printing section 18. Then, the cover status flag is set to the closed state (S16), upon which the printing operation becomes ready. It should be noted that, when the cover status flag is not set to the opened state, the leading edge setting processing of S15 is not performed even if the cover open/close switch 27 is in the closed state.

Although, conventionally, this processing is performed always manually by sending a feed command or pressing the feed key 33 for example after the label replacement, the leading edge setting operation of the label 9 can be automatically performed simply by opening or closing the front cover 5, which must be performed indispensably for the label replacement according to the present embodiment.

It will be apparent to those skilled in the art that the label printer according to the present invention has been embodied as a portable label printer with its printer body 1 being carried on the user; but the application of the present invention is not limited thereto, namely, the present invention may also embodied as a desk-top type for example.

What is claimed is:

1. A label printer that, while sequentially feeding a long base sheet, prints labels continuously stuck on said long base sheet by a printing section and ejects the printed labels from a label issue port, said label printer being selectably provided with a base sheet path for peeled issue for carrying said base sheet in a direction different from said label issue port via a peeling section after the printing in said printing section and a base sheet path for continuous issue for carrying and ejecting said base sheet attached with said labels printed in said printing section from said label issue port, said label printer being further provided with a base sheet sensor that faces said base sheet path for peeled issue to detect for the base sheet, and mode recognizing means for recognizing a label peeled issue mode or a label continuous issue mode depending on an output of the base sheet sensor.

2. A label printer that, while sequentially feeding a long base sheet, prints labels continuously stuck on said long base sheet by a printing section and ejects the printed labels from a label issue port, said label printer comprising:

a base sheet path for peeled issue for carrying said base sheet in a direction different from said label issue port via a peeling section after the printing in said printing section;

a base sheet path for continuous issue for carrying and ejecting said base sheet attached with said labels printed in said printing section from said label issue port;

a base sheet sensor that faces said base sheet path for peeled issue to detect for the base sheet; and mode recognizing means for recognizing a label peeled issue mode or a label continuous issue mode depending on an output of the base sheet sensor.

3. The label printer according to claim 2 comprising:

a printer body provided with an accommodating section for accommodating a roll of said long base sheet and an opening provided on one side of said accommodating section;

a cover pivotally fixed to said printer body to open or close said opening;

a platen facing said opening, rotatably held on said printer body, and forming a part of said printing section;

a print head held on said cover to form another part of said printing section opposing said platen when said cover is closed; and a pinch roller elastically held on said cover to be pressed against said platen in said base sheet path for continuous issue when said cover is closed.

4. The label printer according to claim 3, wherein a peeling section is provided between said print head opposing said platen and said pinch roller pressed against said platen.

* * * * *